United States Patent [19]

Lundell

[11] Patent Number: 4,925,116

[45] Date of Patent: May 15, 1990

[54] SLOW SPEED SHREDDER

[76] Inventor: Vernon J. Lundell, P.O. Box 171, Cherokee, Iowa 51012

[21] Appl. No.: 319,717

[22] Filed: Mar. 7, 1989

[51] Int. Cl.[5] ..... B02C 18/16

[52] U.S. Cl. ..... 241/236; 241/167; 241/285 B

[58] Field of Search ..... 241/166, 167, 236, 285 A, 241/285 B, 242, 243

[56] References Cited

U.S. PATENT DOCUMENTS

| | | | |
|---|---|---|---|
| 3,360,207 | 12/1967 | Shelton, Jr. | 241/285 A |
| 4,009,838 | 3/1977 | Tashman | 241/236 X |
| 4,733,828 | 3/1988 | Potts | 241/236 |
| 4,757,949 | 7/1988 | Horton | 241/736 X |

*Primary Examiner*—Timothy V. Eley

*Attorney, Agent, or Firm*—Fleit, Jacobson, Cohn, Price, Holman & Stern

[57] ABSTRACT

A shredder for shredding or comminuting trash, waste material and the like in a waste recycling system which includes a hopper having a pair of spaced rotatable shafts with shredding elements thereon forming the bottom portion of the hopper with the shafts being independently driven at a relatively slow speed with the shredding elements being generally circular and having overlapping peripheral portions with staggered teeth thereon and rotating in opposite directions to provide an effective shearing, shredding and comminuting action. The shafts are square with the shredding elements having a correspondingly square central aperture so that they can slip onto the shaft in one of four positions with spacers provided between the shredding elements to maintain them properly spaced thereby eliminating the necessity of using keys or other fastening arrangements. The teeth on each shredding element has an inclined radial face with the teeth being located at circumferentially different positions. Each shredding element includes a plurality of plates with each plate having a tooth or teeth with the outermost teeth being disposed in leading relation to the centrally disposed teeth.

14 Claims, 3 Drawing Sheets

SLOW SPEED SHREDDER

BACKGROUND OF THE INVENTION

Field of the Invention

The present invention generally relates to a shredder for shredding or comminuting trash, waste material and the like in a waste recycling system which includes a hopper having a pair of spaced rotatable shafts with shredding elements thereon forming the bottom portion of the hopper with the shafts being independently driven at a relatively slow speed with the shredding elements being generally circular and having overlapping peripheral portions with staggered teeth thereon and rotating in opposite directions to provide an effective shearing, shredding and comminuting action. The shafts are square with the shredding elements having a correspondingly square central aperture so that they can slip onto the shaft in one of four positions with spacers provided between the shredding elements to maintain them properly spaced thereby eliminating the necessity of using keys or other fastening arrangements. The teeth on each shredding element has an inclined radial face with the teeth being located at circumferentially different positions. Each shredding element includes a plurality of plates with each plate having a tooth or teeth with the outermost teeth being disposed in leading relation to the centrally disposed teeth.

INFORMATION DISCLOSURE STATEMENT

Rotary devices for shredding and comminuting trash, waste material and the like in recycling operations are generally known. Usually, such devices include high-speed rotary components with hammers, flails and the like which contact the waste material to break, chop or otherwise reduce the size of the waste material for subsequent treatment in the recycling process. Applicant is not aware of any shredding device utilizing slow rotational speed side-by-side shafts which are independently driven with the shafts including interdigitated and overlapping rotors with each rotor including at least one radial tooth or surface which serves to shred material positioned on the rotors which are located at the bottom of a hopper.

SUMMARY OF THE INVENTION

An object of the present invention is to provide a slow speed shredder for waste material which includes a hopper for receiving the waste material and a pair of shafts located across the bottom of the hopper with the shafts including overlappinq plate type rotors forming a bottom for the hopper with each of the rotors including at least one radial tooth at the periphery thereof for cooperation with adjacent rotors to shear, cut, shred and comminute waste material and discharge it downwardly between the overlapping rotors.

Another object of the invention is to provide a slow speed shredder in accordance with the preceding object in which the shafts are independently driven at slow speeds with the motor control including the capability of automatically reversing the motor in the event of a jam so that either or both of the shafts and rotors thereon can turn in reverse direction for several revolutions and then automatically return to their normal direction or forward direction thereby automatically eliminating jamming of the shredder.

A further object of the invention is to provide a shredder in accordance with the preceding objects in which each of the rotors includes a plurality of plates with each of the plates including at least one inclined tooth with the outermost teeth or radial surfaces leading the innermost teeth or radial surfaces in order to produce a shearing action and reducing power requirements in view of the staggered relation of the radial surfaces on adjacent and opposed rotors and the leading and lagging arrangement of the radial surfaces or teeth on each rotor.

Still another object of the invention is to provide a slow speed shredder in which the rotors can be replaced or repositioned by merely removing one of the supporting bearings and slipping the rotors from the shaft and replacing them or repositioning them with the hopper including projecting members which extend between the rotors to complete the closure for the bottom of the hopper and strip material from between the rotors with the hopper including a pivotal door to provide access to the rotors when desired thereby providing a long-lasting, dependable, easily repaired and efficient shredder.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
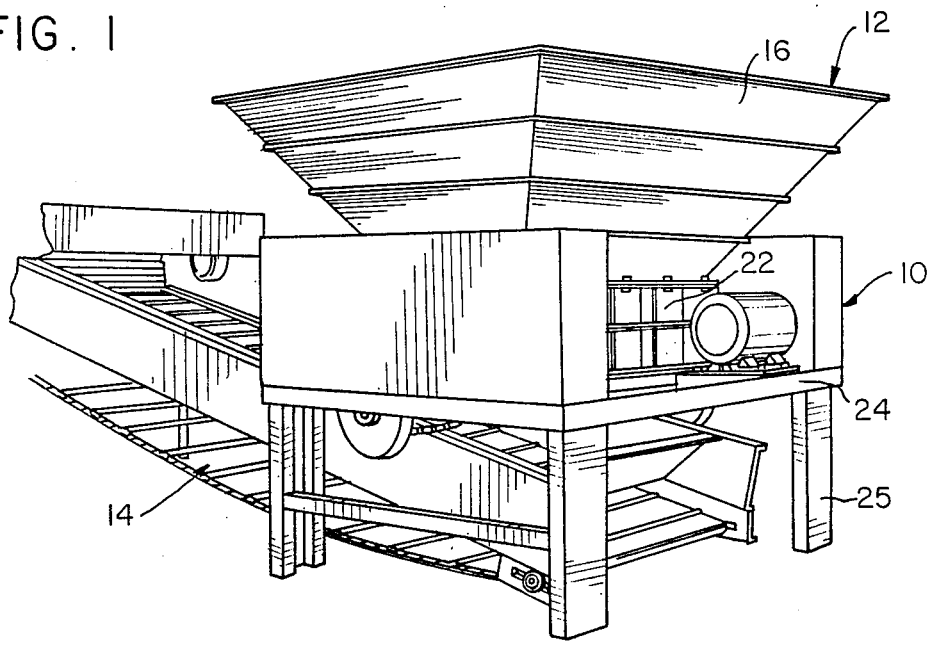
FIG. 1 is a perspective view of the low-speed shredder of the present invention.
Figure 2:
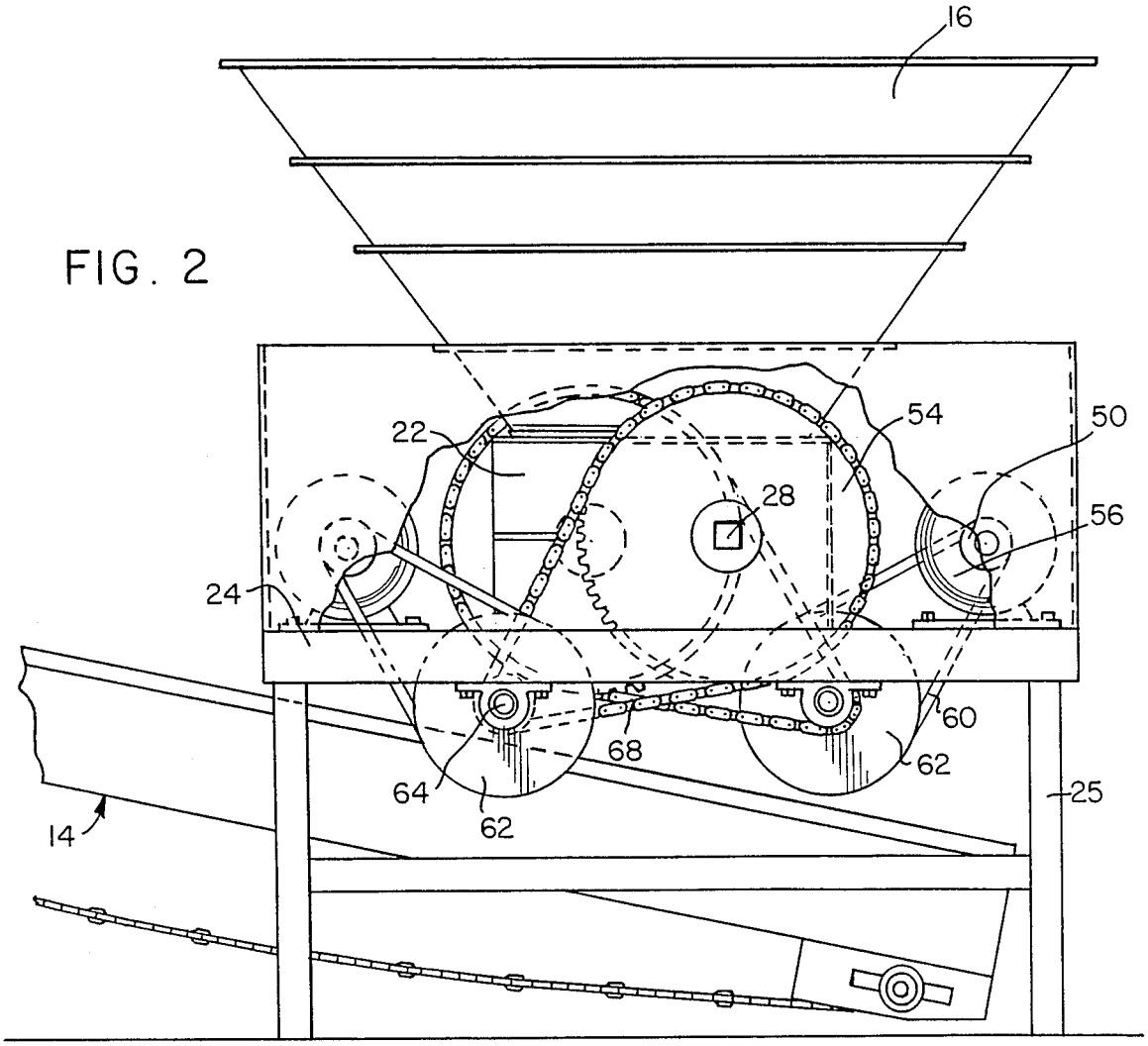
FIG. 2 is a side elevational view of the shredder with a portion of the housing broken away.

Referring now specifically to FIGS. 1–4 of the drawings, the low-speed shredder of the present invention is generally designated by reference numeral 10 and includes a hopper generally designated by the numeral 12 which has an open upper end for receiving trash, waste material or the like to be shredded. An off-bearing conveyor structure generally designated by the numeral 14 is positioned under the hopper and shredder to remove the shredded material discharged from the shredder with the conveyor being in and of itself a conventional structure and forming no particular part of the invention except that it is used for removing the discharged material from the shredder.

Figure 3:
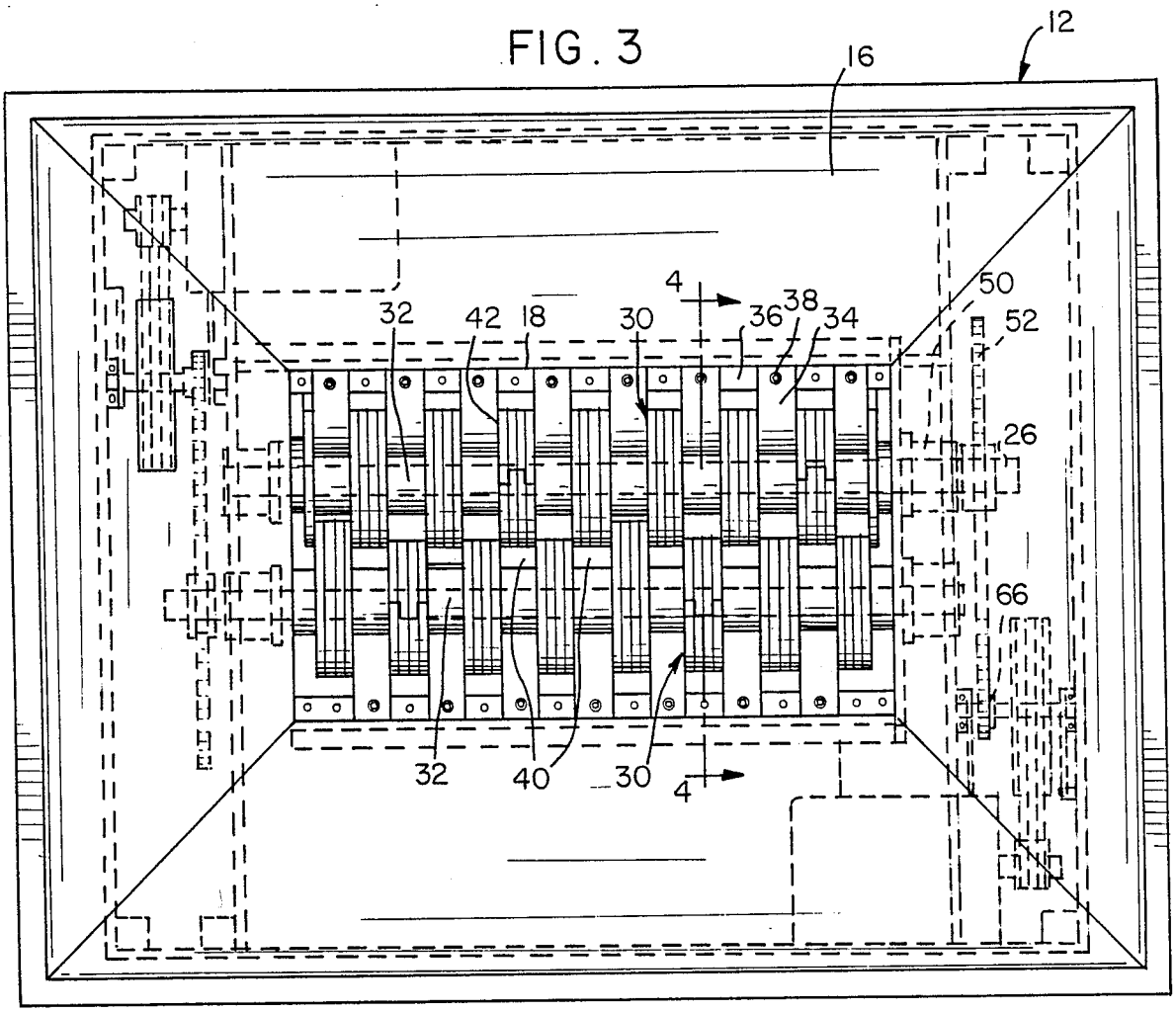
FIG. 3 is a top plan view of the shredder.
Figure 4:
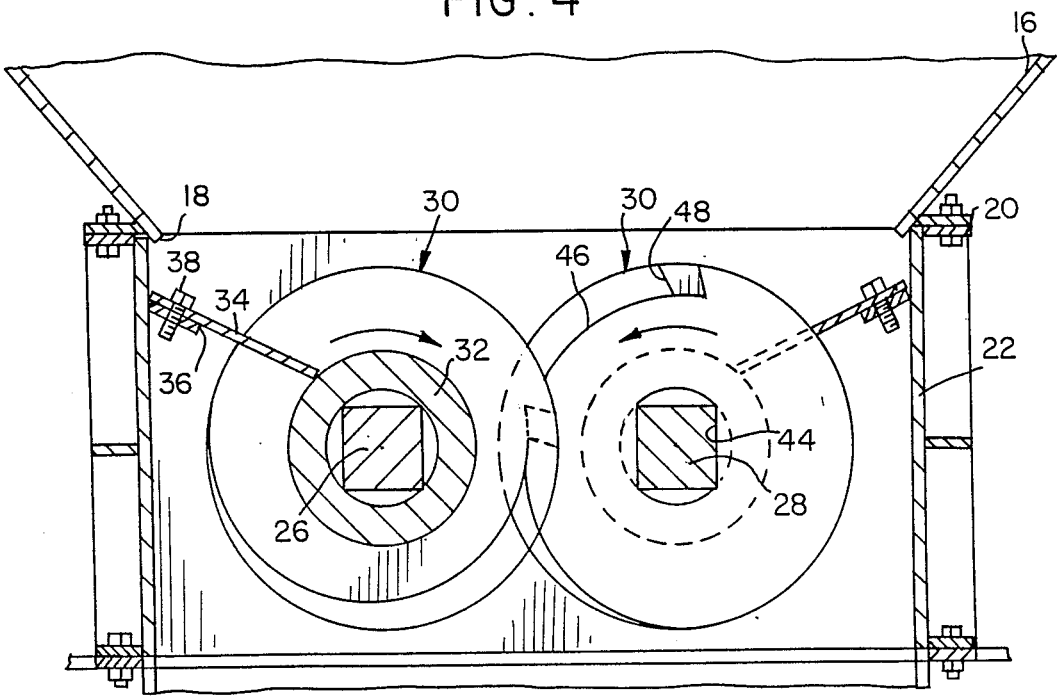
FIG. 4 is a transverse, sectional view of the shredder taken substantially upon a plane passing along section line 4—4 on FIG. 3 illustrating the structural details of the rotors and their relationships to the other components.

The hopper 12 includes upwardly and outwardly inclined walls 16 which define an open top and which slope inwardly to form generally a rectangular opening 18 at the bottom thereof as illustrated in FIGS. 3 and 4. The hopper 12 is supported by flanges 20 projecting outwardly from the lower ends of the walls 16 as illustrated in FIG. 4 which are supported on flanges at the upper end of vertical walls or plates 22 forming part of the shredder and which form a continuation of the opening 18. The lower ends of the plates 22 are supported from a support frame 24 having support legs 25 attached thereto with the support frame 24 forming a continuation of the opening so that material may be discharged from the shredder onto the conveyor 14. Extending between opposed walls 22 and lengthwise below the opening 18 is a pair of elongated shafts 26 and 28 each of which is of square cross-sectional configuration as illustrated in FIG. 4. Each of the shafts 26 and 28 has a plurality of rotors 30 thereon which are spaced from each other by cylindrical or tubular spacers 32 and which are positioned in staggered relation to each other with the peripheries of the rotors 30 on the shaft 26 overlapping the peripheries of the rotors 30 on the shaft 28 as illustrated in FIGS. 3 and 4. Opposed plates 22 include inwardly extending plates 34 which extend between adjacent rotors 30 on each of the shafts 26 and 28 to prevent material from becoming lodged between the adjacent rotors 30 against the exterior of the spacer 32 with the plates 34 being removably supported from flanges or lugs 36 secured to the walls 22 by fasteners 38 and the like so that the combined periphery of the spacers 32, periphery of the rotors 30 and the plates 34 form a substantial closure for the opening defined by the vertical walls or plates 22 which is a continuation of the opening 18 as illustrated in FIG. 3. However, small openings 40 are provided between the side walls of adjacent rotors 30 on one shaft, the periphery of the spacer 32 therebetween and the periphery of the opposite rotor on the opposite shaft as illustrated in FIG. 3.

Each rotor 30 includes a plurality of generally circular plates 42 each of which has a square central aperture 44 for driving engagement with the square shaft on which it is mounted so that no keys or other fastening devices, such as set screws and the like, are necessary to secure the rotors in non-rotative relation on the shaft which drives and mounts them. Each of the plates 42 includes a portion of the periphery which spirals inwardly at 46 to form a generally radially extending tooth face 48 which is inclined outwardly and in the direction of rotation as illustrated in FIG. 4 so that waste or trash positioned on the upper surface of the rotors will be pulled downwardly when engaged by the inclined radial surface 48. As illustrated, the two outermost plates 42 have their faces 48 arranged in leading relation to the inclined radial surfaces on the centermost plates 42 so that the two outer plates have inclined radial surfaces oriented in leading relation to the inclined radial surfaces on the two innermost plates. Also, as illustrated, the inclined radial surfaces on the rotors 30 on the shaft 26 are staggered in relation to each other and in relation to the rotors on the shaft 28 thus enhancing the efficiency of the shredding action and reducing the power requirements for driving the rotors.

The shafts 26 and 28 extend through the end walls 22 and are supported by bearing structures 50 which can be easily removed along with an end plate to enable the assembly and disassembly of the shafts and rotors and enable replacement of the rotors or repositioning of the rotors as desired. It is pointed out that the endmost rotors on the shaft 26 are in the form of a single plate 42 although this could be altered depending upon the overall length of the shredder. The two shafts are independently driven with the shaft 26 having a large sprocket gear 52 mounted thereon and the shaft 28 is provided with a similar large sprocket gear 54 with the sprocket gears being at opposite ends of the respective shafts so that the sprocket gear 52 can be driven by an electric motor 56 through a drive pulley 58, belts 60, a driven pulley arrangement 62 on an idler shaft 64 which has a sprocket gear 66 thereon engaged with a sprocket chain 68 which drives the sprocket gear 52. A corresponding drive arrangement is provided for the other sprocket gear 54 so that the two shafts 26 and 28 are independently driven by reversable motors 60. By using independent reversable motors, the shaft speed may vary in relation to each other depending upon loads encountered and even if one shaft becomes jammed, the other will continue to rotate which may result in unjamming of the shaft or rotors and the motor control may be provided with an automatic reverse cycle in the event of jamming so that the jammed shaft will be rotated for a short cycle in reverse direction and then returned to its original direction of rotation. Thus, a heavy duty relatively slow speed shredder is provided that is of rugged construction inasmuch as each rotor plate includes a single tooth or notch which forms a radial surface that inclines outwardly and in the direction of rotation. The structure enables quick and easy replacement of the wear components and provides a dependable, long-lasting and efficient shredder.

Figure 5:
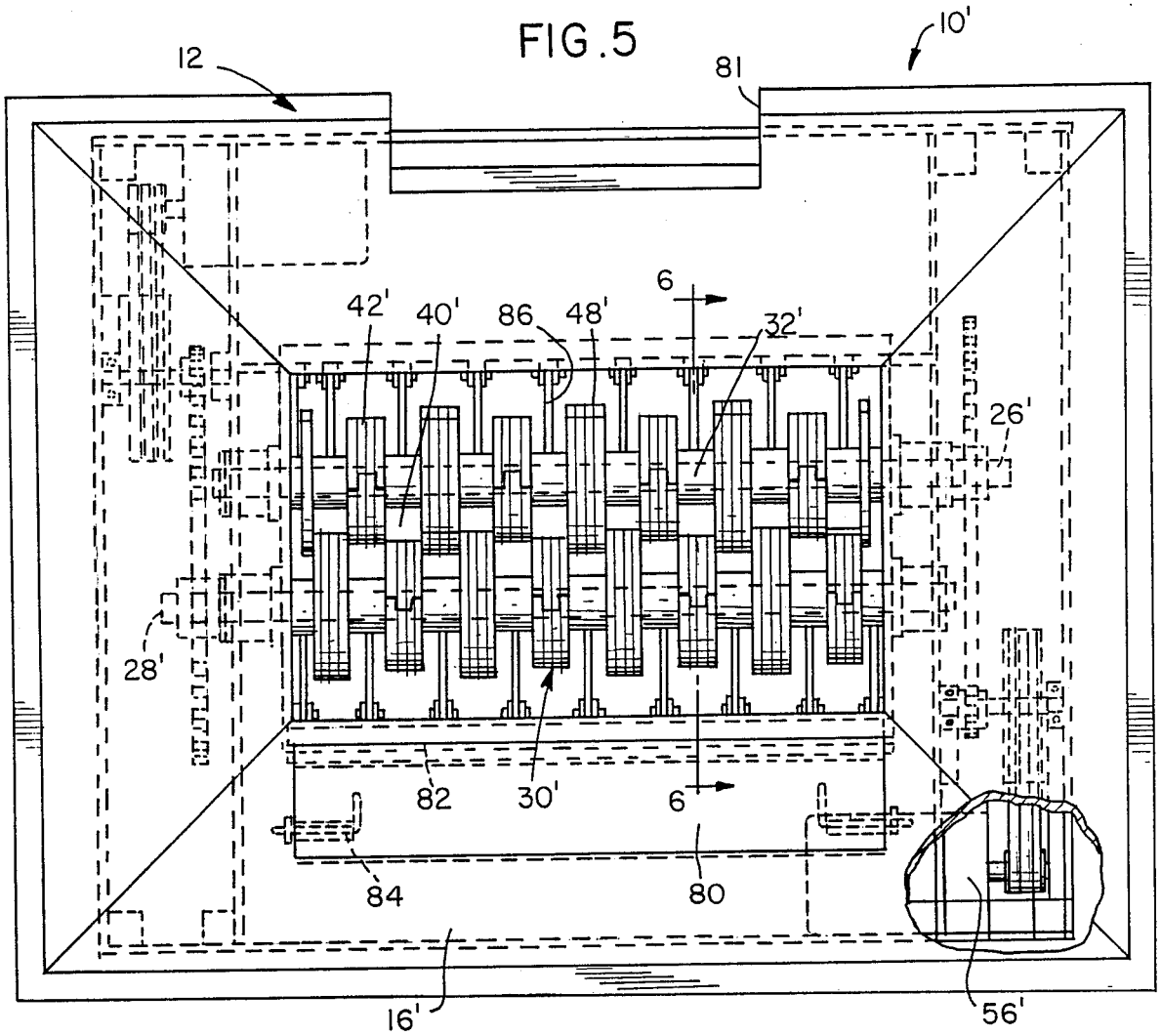
FIG. 5 is a top plan view of another embodiment of the slow speed shredder.
Figure 6:
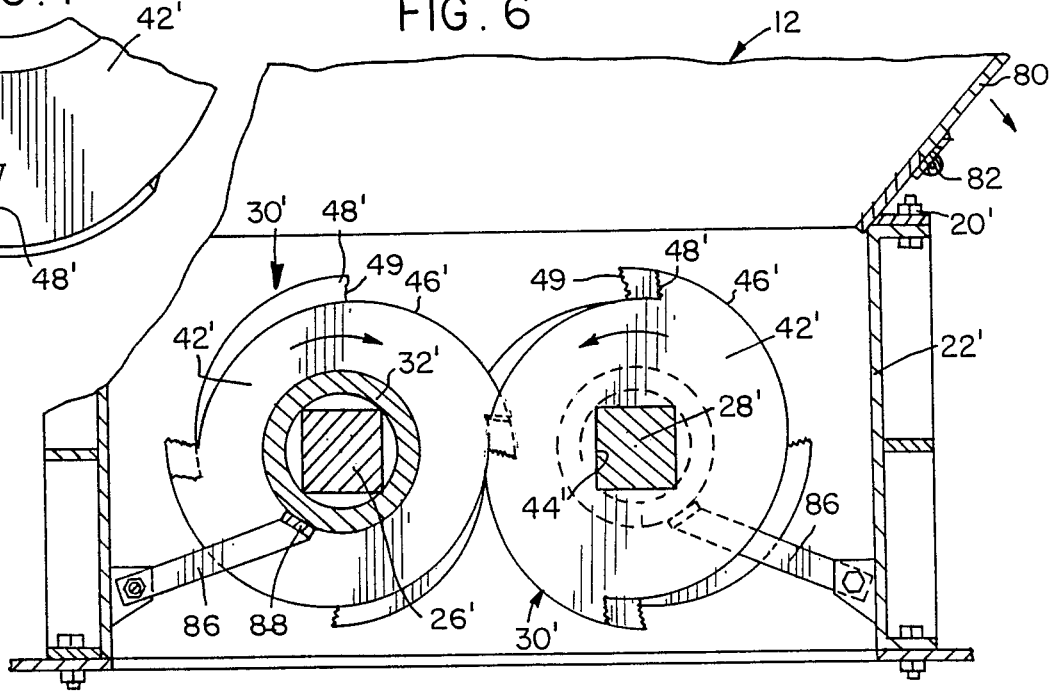
FIG. 6 is a sectional view taken along section line 6—6 on FIG. 5.

FIGS. 5 and 6 illustrate a modified embodiment of the slow speed shredder in which primed reference numerals are used for structural components in this embodiment of the invention which correspond with the embodiment illustrated in FIGS. 1–4.

In this embodiment of the invention, indicated by reference numeral 10', an inclined side wall 16' is provided with a generally rectangular access door 80 which has a length generally equal to the length of the rotors 30' to provide access to the rotors when the door is in open position. The door extends from a point adjacent the inclined wall 16' to a point adjacent the upper end thereof and is supported by hinges 82 at the bottom edge of the door and secured in closed position by a latch or latches 84 adjacent the upper end thereof. The provision of the door provides access to the rotors without the necessity of an operator climbing to the top of the hopper 12' and leaning into or actually crawling into the hopper for the purpose of repairing the rotors in sito. The door enables an operator to repair the rotors such as by reshaping the teeth by welding or other techniques and also enables removal of material from the hopper when desired or necessary.

Another feature of the modified embodiment of the invention is the provision of stripper plates 86 located near the bottom of the walls 22' and which extend upwardly and inwardly to a point adjacent the periphery of the spacers 32' which are of reduced thickness as compared to those illustrated in FIGS. 1–4 to provide more throat area for passage of material downwardly between the rotors 30'. The stripper plates 86 are in the form of rigid metal bars or straps having their longer dimension perpendicular to the rotational axes of the rotors 30' with the inner ends thereof being inclined as at 88 to provide a pointed end facing the direction of rotation of the rotors 30' to more effectively strip the material that may be accumulating on the spacers 32' with any tendency of the stripper plates to be deflected causing the inclined ends 86 thereof to come into contact with the spacers 32' thereby preventing the stripper plates from becoming bent due to contact with material that may be difficult to strip.

A very important feature of the modified embodiment of the invention are the plates 42' mounted on the shafts 26' and 28' with each plate 42' having a square aperture 44' receiving the square shaft to enable the plates 42' to be oriented in 90° adjusted positions in relation to the shafts. The plates 42' are different in configuration from the plates 42 in FIGS. 1–4 in that the plates 42' include two radial surfaces or teeth 48' that are inclined in the direction of rotation to prevent the material from being forced away from the axis of rotation of the rotors 30' with each of the radial surfaces or teeth 48' being transversely serrated at 49 to further provide a gripping engagement with the material being shredded and preventing such material from being wedged upwardly away from the rotors as the teeth 48' move inwardly in the direction of the arrows illustrated in FIG. 6. With each of the plates 42' having diametrically opposed teeth arrangements, the plates or cutters 42' can fit in the shredder at any position and, as in FIGS. 1–4, the plates can be of laminated construction or multiple plates can be used with the width of each rotor 30' being varied by adding or removing individual plate 42'. The use of the alternative disc and its particular shape and tooth arrangement produces better agitation of the material in the hopper and the shape of the tooth assures better gripping engagement with the material being sheared as the teeth 48' carry the material downwardly between adjacent cutting elements or plates 42'. This reduces the tendency of the material to jamb since each plate 42' includes opposed spiral surfaces 46' which introduce more vertical agitation or movement to the waste material positioned against the upper surface of the rotors 30'.

In addition to the access door 80, the opposite wall 16' is provided with a cut out 81 at the upper edge thereof to receive the discharge end of a presort conveyor to facilitate deposit of the material to be communicated into the hopper.

Figure 7:
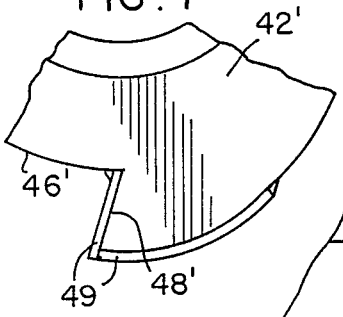
FIG. 7 is a fragmental view of another form of rotor with replaceable wear tips.

The teeth 48 or 48' may be staggered as shown in FIGS. 1–6 or, as shown in FIG. 7, all of the teeth may be in transverse alignment and provided with replaceable steel wear tips 49 with a single tip bridging all of the teeth 48 or 48' and extending over a portion of the spiral surface 46'. The wear tips 49 may be secured in place by welding or any suitable fastening arrangement.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A slow speed shredder for waste material comprising an upwardly flared hopper having an open upper end and an open lower end, depending vertical walls connected with the periphery of the open lower end of a hopper, a pair of generally horizontally disposed, parallel shafts extending between opposed vertical walls with each of said shafts being independently driven by independent drive means, drive means for rotation in opposite directions, and a plurality of longitudinally spaced rotors mounted on each of said shafts, each of said rotors comprising a generally circular plate means having at least one portion spiralling inwardly to form at least one generally radially extending surface facing in the direction of rotation for engaging waste material placed on the rotors and shredding the waste material between opposed rotors and discharging it downwardly below the rotors, said generally radial surface on each plate means being inclined in the direction of rotation for engaging and retaining the waste material in position for shredding, each plate means including a plurality of side-by-side plates with the inclined radial surfaces on the outermost plates leading in the direction of rotation as compared with the inclined radial surfaces on the innermost plates.

2. The shredder as defined in claim 1 wherein each of said shafts has a polygynol cross-sectional configuration and each of said plates includes a correspondingly shaped central aperture to slidably mount the plates on the shafts in non-rotative relation without fasteners, keys and the like.

3. The shredder as defined in claim 2 together with a cylindrical spacer between each rotor for maintaining them in spaced parallel relation, the periphery of the rotors on one of said shafts overlapping the periphery of the rotors on the other shaft with the rotors turning inwardly and downwardly through the peripheral overlapping portions.

4. The shredder as defined in claim 3 wherein the cross-sectional configuration of each shaft is square and the aperture in each rotor is correspondingly square to enable positioning of the rotors in four positions in relation to the square shafts thereby enabling the inclined radial surfaces to be staggered in relation to each other and positioned in selective relationship.

5. The shredder as defined in claim 4 together with end bearing means supporting the shafts and being removable to enable positioning and replacement of rotors on the shaft.

6. The shredder as defined in claim 5 wherein the vertical walls adjacent to and parallel to the shafts include inwardly extending plates oriented between the rotors and having an inner end terminating adjacent the periphery of the spacers to clean the space between the rotors and prevent accumulation of waste material therein.

7. The shredder as defined in claim 6 wherein each independent drive means for the shafts includes an electric motor so that excessive load on one of the shafts will not affect the speed of the other and one of the shafts will continue to rotate even if the other shaft is jammed thereby cleaning the jammed material from the shredder with the electric motors being reversible and controlled in a manner to automatically go into a short reverse cycle for unjamming the shredder and then returning to forward cycle.

8. The structure as defined in claim 6 wherein said inwardly extending plates are supported from the vertical wall below the axis of rotation of the rotors and terminating in inner ends inclined to generally conform with the periphery of the spacers with a pointed corner of the inner end facing the direction of rotation of the spacers and disposed so that tendency of the inwardly extending plates to deflect by engagement with material lodged adjacent the outer surface of the spacers causing the inner ends of the inwardly extending plates to come into contact with the periphery of the spacers to preclude bending of the inwardly extending plates.

9. The shredder as defined in claim 1 wherein said hopper includes upwardly inclined walls, one of said walls including a door providing access to the interior of the hopper, said door including hinge supporting means at the lower edge thereof and latch means adjacent the upper edge thereof for securing the door in closed position with the door providing access to the interior of the hopper for repair of the rotors and removal of material from the hopper when desired.

10. The structure as defined in claim 9 wherein a wall of said hopper includes a cut out in the upper edge thereof for receiving the discharge end of a presort conveyor for discharging material in the hopper.

11. The structure as defined in claim 1 wherein each of said plates includes a pair of opposed spiral surfaces terminating in a radially extending surface forming a tooth with each tooth having an outer end inclined in the direction of rotation, each tooth also being serrated for better gripping engagement with waste material for pulling it down between opposed rotors.

12. The structure as defined in claim 1 wherein each of said plates includes a pair of spiral surfaces terminating in a radial surface forming a tooth, each tooth being inclined in the direction of rotation, and a replaceable wear tip bridging and rigidly affixed to the aligned teeth on the plurality of plates, each wear tip including a portion covering a short portion of the spiral surface.

13. A slow speed shredder for waste material comprising hopper means having an open upper end and an open lower end, a pair of generally horizontally disposed, parallel shafts extending between opposed portions of the open lower end of the hopper means, drive means for rotating said shafts in opposite directions, and a plurality of longitudinally spaced rotors mounted on each of said shafts, each of said rotors comprising a generally circular plate means having at least one portion spiralling inwardly to form at least one generally radially extending surface facing in the direction of rotation for engaging waste material placed on the rotors and shredding the waste material between opposed rotors and discharging it downwardly below the rotors, said rotors being of the same size and equally spaced from each other a distance generally equal to the width of the rotors, the periphery of the rotors on one of said shafts overlapping the periphery of the rotors on the other shaft, said rotors being of the same size and equally spaced from each other a distance generally equal to the width of the rotors, the periphery of the rotors on one of said shafts overlapping the periphery of the rotors on the other shaft, each of said plate means including a plurality of side-by-side plates with the inclined radial surface on the side-by-side plates being oriented in staggered relation to provide peripherally spaced radially extending surfaces on each rotor.

14. The shredder as defined in claim 15 wherein said hopper means includes inwardly extending stripper plates extending upwardly and inwardly toward the shafts and between the rotors with each stripper plate having an inner end terminating adjacent the periphery of the shafts to clean the space between the rotors and prevent accumulation of waste material therein.

* * * * *